US012252954B2

(12) United States Patent
Tanskanen et al.

(10) Patent No.: US 12,252,954 B2
(45) Date of Patent: Mar. 18, 2025

(54) METHOD AND A DRILL BIT FOR SEALING A BLASTHOLE WALL

(71) Applicant: L&T MINING SOLUTIONS OY, Kuorevaara (FI)

(72) Inventors: Lasse Tanskanen, Kuorevaara (FI); Timo Tanskanen, Kuorevaara (FI)

(73) Assignee: L&T MINING SOLUTIONS OY, Kuorevaara (FI)

( * ) Notice: Subject to any disclaimer, the term of this patent is extended or adjusted under 35 U.S.C. 154(b) by 0 days.

(21) Appl. No.: 17/773,557

(22) PCT Filed: Oct. 27, 2020

(86) PCT No.: PCT/EP2020/080133

§ 371 (c)(1),
(2) Date: Apr. 29, 2022

(87) PCT Pub. No.: WO2021/083865

PCT Pub. Date: May 6, 2021

(65) Prior Publication Data

US 2022/0389790 A1 Dec. 8, 2022

(30) Foreign Application Priority Data

Oct. 30, 2019 (EP) ..... 19206360

(51) Int. Cl.
*E21B 33/138* (2006.01)
*E21B 10/60* (2006.01)

(52) U.S. Cl.
CPC ..... *E21B 33/138* (2013.01); *E21B 10/60* (2013.01)

(58) Field of Classification Search
CPC ..... E21B 33/138; E21B 7/20; E02D 5/46
USPC ..... 405/146, 147, 150.1, 150.2
See application file for complete search history.

(56) References Cited

U.S. PATENT DOCUMENTS 3,116,800 A * 1/1964 Kammerer ..... E21B 21/10 175/406
3,268,017 A * 8/1966 Yarbrough ..... E21B 21/08 175/215
4,438,813 A * 3/1984 Nikolaev ..... E21B 27/02 166/387
4,449,856 A * 5/1984 Tokoro ..... E02D 3/12 405/269
4,784,223 A * 11/1988 Worrall ..... E21B 7/20 166/287
5,256,004 A * 10/1993 Gemmi ..... E02D 3/12 405/262

(Continued)

*Primary Examiner* — Kenneth L Thompson
(74) *Attorney, Agent, or Firm* — McDonnell Boehnen Hulbert & Berghoff LLP

(57) ABSTRACT

A method and a drill bit (11) for sealing a blasthole wall (31) are disclosed. The method comprises drilling a blasthole to a rock by a drill bit (11) connected to a hollow drill rod (10); flushing the drill bit (11) and the hollow drill rod (10) via at least one flushing orifice (19); providing a sealant to the hollow drill rod (10); and releasing the sealant to the blasthole wall (31) while lifting the drill bit (11). The drill bit (11) comprises a flushing orifice (19) and a sealant orifice (12), wherein the flushing orifice (19) is below the sealant orifice (12); and the method comprises covering the flushing orifice (19) after completing drilling the blasthole; providing the sealant to the drill bit (11); and releasing the sealant via the sealant orifice (12) while lifting the drill bit (11).

13 Claims, 5 Drawing Sheets

(56) References Cited

U.S. PATENT DOCUMENTS

| | | | | |
|---|---|---|---|---|
| 5,533,571 | A * | 7/1996 | Surjaatmadja | E21B 34/142 166/318 |
| 7,387,174 | B2 * | 6/2008 | Lurie | E21B 7/20 175/57 |
| 7,516,802 | B2 * | 4/2009 | Smith, Jr. | E21B 43/11 175/171 |
| 8,992,130 | B2 * | 3/2015 | Horman | E21B 33/138 405/269 |
| 9,896,894 | B2 * | 2/2018 | Barison | E21B 33/138 |
| 11,428,051 | B2 * | 8/2022 | Ogelohwohor | E21B 23/03 |

* cited by examiner

METHOD AND A DRILL BIT FOR SEALING A BLASTHOLE WALL

CROSS REFERENCE TO RELATED APPLICATION

This application is a U.S. National Phase of International Application No. PCT/EP2020/080133, filed Oct. 27, 2020, which claims priority to European Patent Application No. 19206360.0, filed Oct. 30, 2019, both of which are incorporated by reference herein in their entirety.

BACKGROUND

In mining and rock excavation, a blasthole may be drilled to the rock and filled with solid, granular, slurry, gel, emulsion or liquid explosives. For example, the liquid explosive is pumped into the blasthole and detonated controllably. The amount of rock breakage or rock fractures may be controlled with the amount of explosive material inserted into the blasthole. The blastholes may be drilled and detonated in series to further control the direction of fractures.

Sometimes the rock has natural fractures that are not visible to the drill operator. Consecutive blasts may cause further fractures to the rock. The position, direction or magnitude of the fractures extending from the blasthole wall may not be anticipated from the surface. The blasthole drilling process may cause further fractures or cracks to the rock. When the blasthole is filled with the explosives, at least portion of the explosives may enter the fractures. This makes controlled rock blasting more difficult. When the explosives are detonated, the rock may break uncontrollably along the fractures extending from the blasthole wall.

Additionally, or alternatively, the blasthole walls may contain small fragments that are crushed during drilling. The fragments may fall deeper into the blasthole and fill the bottom of the blasthole when the drill is lifted. Said fragments, small particles or sand may create an obstacle that blocks a feeding tube configured to fill the blasthole with explosives. In order to complete filling the blasthole, the feeding tube must be lifted from the blasthole and the drill assembly must be inserted again to clear the bottom of the blasthole. Sometimes the clearing process must be repeated several times, causing waste of time and resources.

Blasthole walls may be covered with a tubular liner or the drilling rod may be used to provide concrete paste for covering the walls. EP0777018A1 discloses a method of producing a concrete encasing in the hole by supplying a liquid or pasty concrete material via pipes arranged in the drill rod to a set of nozzles and expelling substance to the hole from openings in the drill rod. The material solidifies while lifting the drill bit from the hole.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

A method and a drill bit for sealing a blasthole wall are disclosed. A drill rod may comprise multiple consecutive parts that are added to the drill rod as the drilling proceeds.

The drill rod is hollow, allowing a drilling fluid to pass through the drill rod to a drill bit. The drilling fluid flushes the drill bit and the blasthole during drilling.

After the blasthole has been drilled to the desired depth, the drilling fluid is flushed from the drill rod. The drill bit comprises a flushing orifice for flushing the blasthole and a sealant orifice. The flushing orifice is covered by an object, leaving the sealant orifice open. The object may be a ball that is dropped into the hollow drill rod while the drill assembly is in the desired depth.

The sealant is provided into the drill rod and pushed towards the drill bit. The sealant cannot pass through the blocked flushing orifice, instead it flows through the sealant orifice, outside the drill bit and into the blasthole wall. The sealant orifice is positioned higher than the flushing orifice in the drill bit. The drill assembly is rotated while the sealant covers the blasthole walls. The rotating drill assembly is lifted from the blasthole, wherein the rotating drill bit shapes the blasthole wall. The centrifugal force and the pressure applied to the sealant causes the sealant to penetrate into the fractures. The sealant comprises sufficient viscosity to prevent it from sagging when the drilling assembly has been lifted.

The sealant shapes the blasthole wall to the desired shape and size. The blasthole walls may be formed with the same equipment used at the drilling, without the need for lifting the drill rod from the blasthole. The functionality is arranged into the drill bit. There are no special requirements for the drill rod assembly. The blasthole operator may use standard drill rod inventory, which reduces the number of errors and need for different spares. The drill rods may be easily sourced from multiple vendors.

Many of the attendant features will be more readily appreciated as they become better understood by reference to the following detailed description considered in connection with the accompanying drawings. The embodiments described below are not limited to implementations which solve any or all the disadvantages of known blasthole drilling solutions.

BRIEF DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. However, the same or equivalent functions and sequences may be accomplished by different examples.

Although the present examples are described and illustrated herein as being implemented in vertical blasthole formation, they are provided as an example and not a limitation. As those skilled in the art will appreciate, the present examples are suitable for application in a variety of different types of rock drilling applications.

Figure 1:
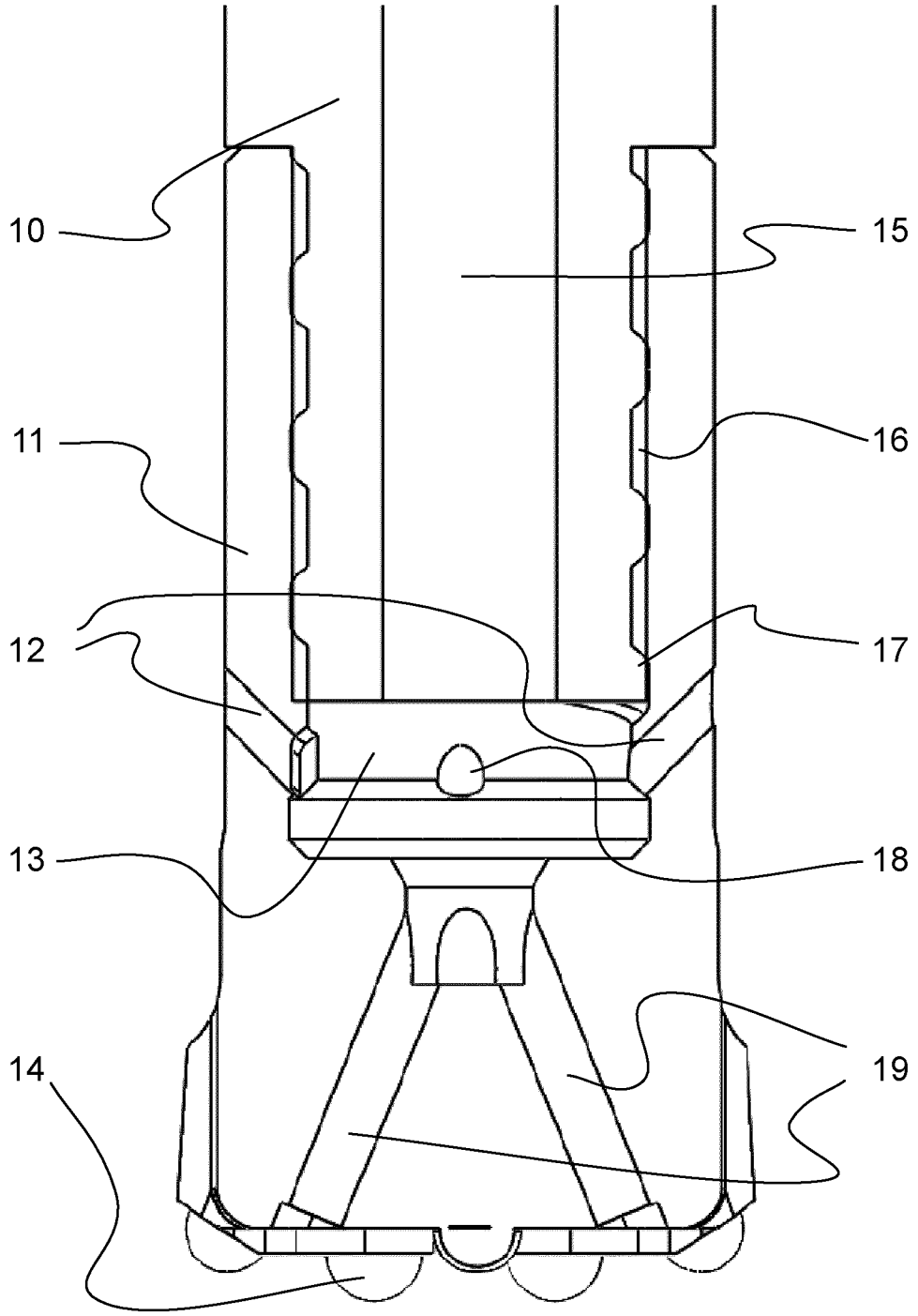
FIG. 1 illustrates a cross-sectional view of one exemplary embodiment of a drill bit connected to the drill rod.

A method and a drill bit for sealing a blasthole wall are disclosed. FIG. 1 illustrates a cross-sectional view of one exemplary embodiment of the drill bit 11 connected to the drill rod 10. In the present example the connection is provided by an female thread 16 configured to the drill bit 11 and a male thread configured to the drill rod 10. Various alternatives for connecting the drill bit 11 to the drill rod 10 may be applied without altering the scope of the invention.

The drill rod 10 is hollow. In this example the hollow portion 15 is in the middle of the drill rod 10. The hollow portion 15 allows flushing fluid to pass through to the drill bit 11 and to at least one flushing orifice 19 arranged near the drill bit buttons 14. The drilling fluid is pumped to the drill rod 10. The drilling fluid provides hydrostatic pressure to prevent formation fluids from entering into the blasthole, keeps the drill bit 11 cool and clean during drilling, carries out drill cuttings, and suspends the drill cuttings while drilling is paused and when the drilling assembly is brought in and out of the hole. The flushing fluid may be liquid, gas, water-based muds, non-aqueous muds, oil-based muds (OBs); and gaseous drilling fluid, in which a wide range of gases can be used.

The drill bit 11 comprises at least one flushing orifice 19 and at least one sealant orifice 12. During the drilling, portion of the flushing fluid may also pass through the sealant orifice 12. Before starting the process of sealing the blasthole wall, the flushing orifice 19 is blocked. In the present example the flushing orifice 19 is positioned below the sealant orifice 12 in the drill bit 11, when drilling downwards. The directions up, down, lower, upper or higher are related to the present examples. It is obvious to a man skilled in the art that the drilling may be made at any direction, wherein the directional definitions described herein are to be transformed to the direction of drilling.

Figure 2:
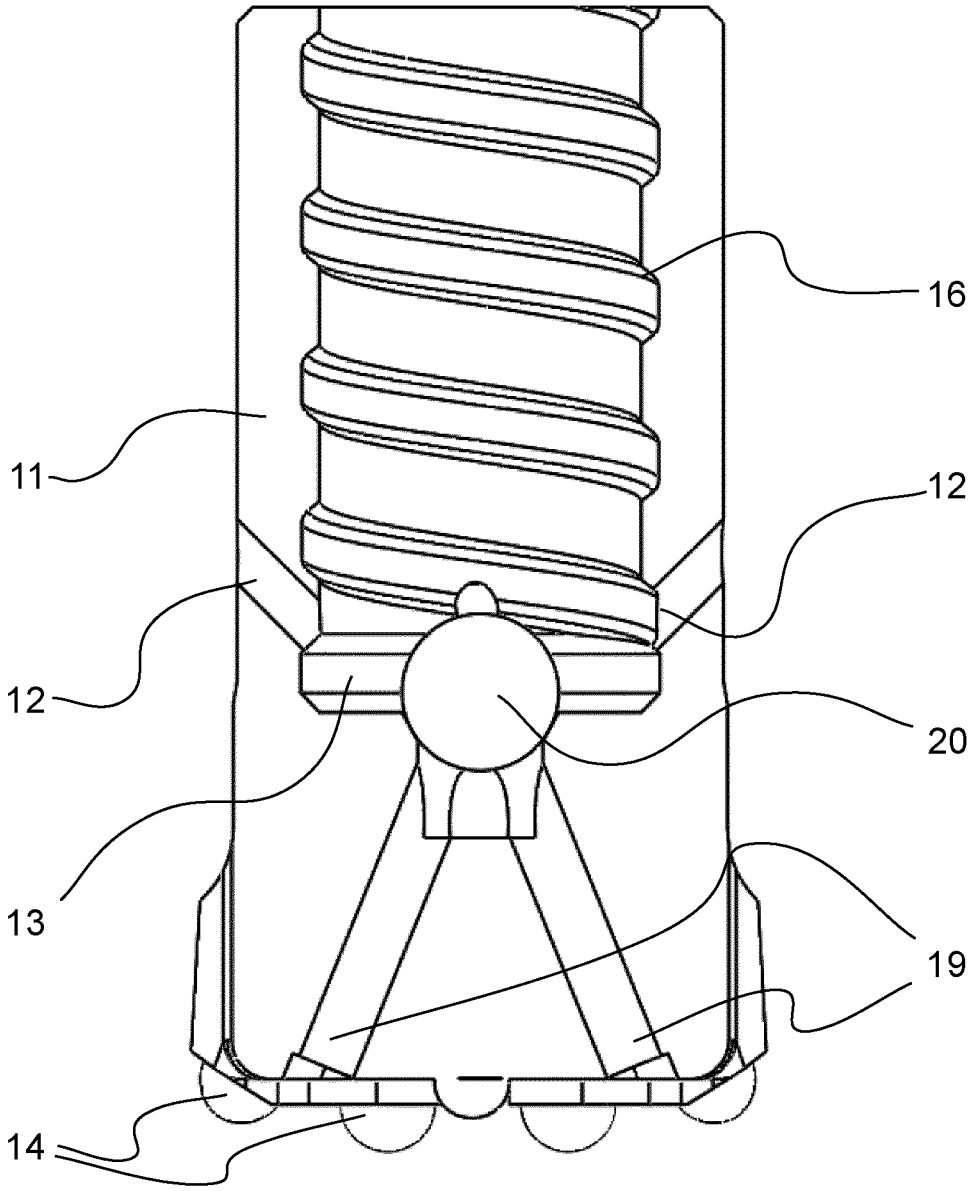
FIG. 2 illustrates a cross-sectional view of one exemplary embodiment of a drill bit.

FIG. 2 illustrates a cross-sectional view of one exemplary embodiment of the drill bit 11. The drill bit 11 comprises a chamber 13 below the female thread 16 when the drill bit 11 is connected to the drill rod 10. In the present embodiment the sealant orifice 12 is arranged at the wall of the chamber 13, extending towards the blasthole walls. Inside the chamber 13 is a seat 18 configured to receive an object for blocking the flushing orifice 19. In one embodiment the seat 18 is directly below the hollow portion 15 of the drill rod 10. The object 20, such as a ball, is dropped into the hollow portion 15 of the drill rod 10. The ball 20 is visible in FIG. 2, but not in FIG. 1. The ball 20 falls onto the seat 18 and blocks the flushing orifice 19. Alternatively, instead of falling, the object 20 may be pushed through the drill rod 10 by pumping fluid to the drill rod 10. This enables passing the object 20 through the drill rod 10 at any angle. The seat 18 is configured to match the shape of the object 20. A sealant may be pumped through the drill rod 10 to the drill bit 11, wherein it passes only through the sealant orifice 12, not the flushing orifice 19.

Figure 3:
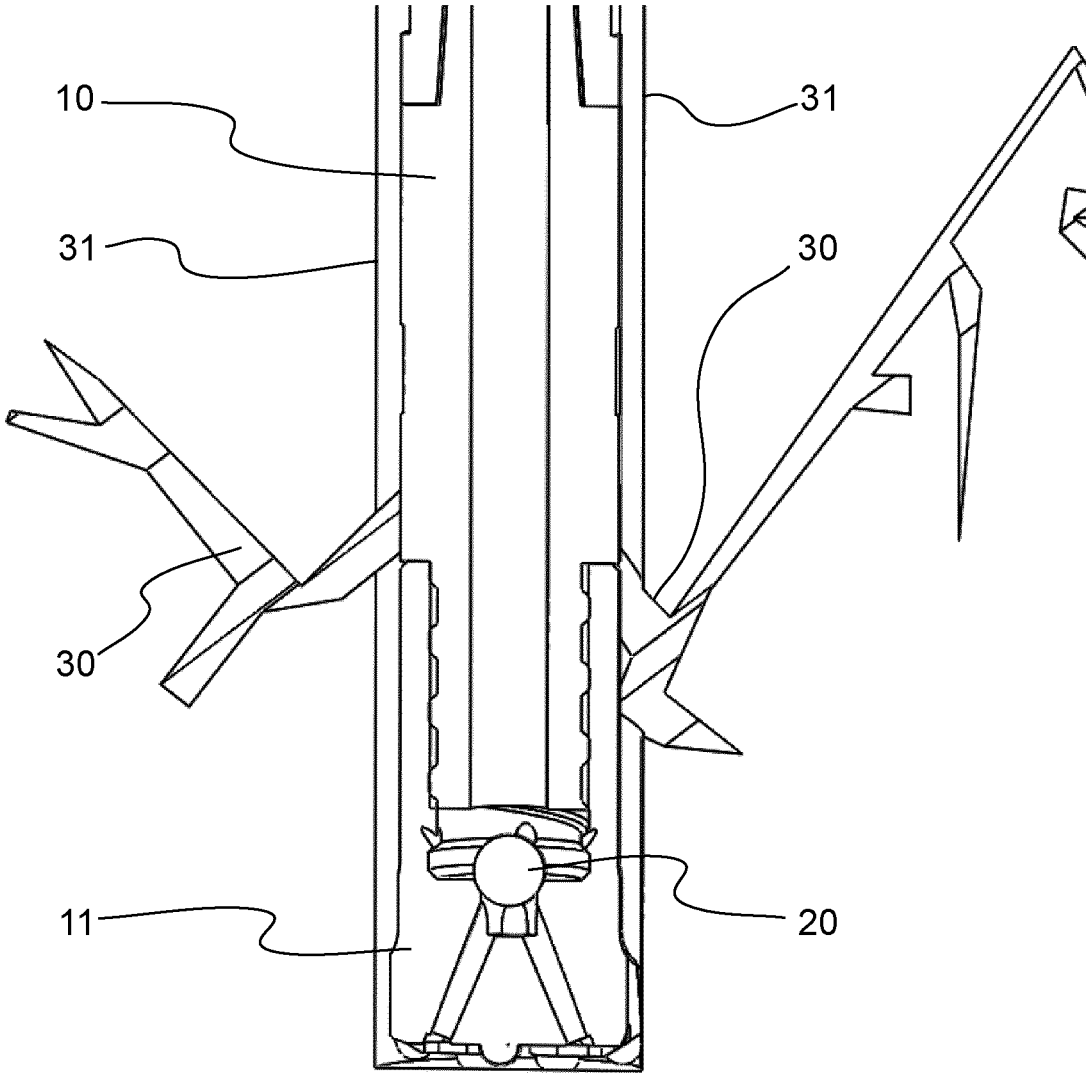
FIG. 3 illustrates a cross-sectional view of one exemplary embodiment inside a blasthole.

FIG. 3 illustrates a cross-sectional view of one exemplary embodiment inside a blasthole. The rock mass has fractures 30, some of them extending through the blasthole walls 31. The fractures 30 may occur naturally in the rock or previous blasts may have caused fractures 30 inside the rock mass. Sometimes the shape, direction or magnitude of the fractures 30 is difficult to predict. In the blasthole detonation method according to prior art, the drilled blasthole is filled with solid, granular, slurry, gel, emulsion or liquid explosives. The explosives may enter the fractures 30 and cause unexpected reactions when detonated. The direction and the effect of the blast may cause further problems.

Alternatively, or in addition, the drilling process may separate small fragments from the edges of the fractures 30, that fall into the blasthole bottom when the drill assembly 10, 11 is lifted from the blasthole. In one method explosives are pumped into the blasthole via a tube inserted to the blasthole. The tube may not reach the bottom of the blasthole due to the fragments blocking the passage. When the situation is detected at the surface, the drill assembly 10,11 must be inserted again into the blasthole to flush the fragments away. This may be very time consuming process.

In the present example the drill assembly 10, 11 has finished drilling and reached the desired depth. The ball 20 has been dropped from the surface, via the drill rod 10, onto the seat 18 to block the flushing orifice 19. The sealant is pumped via the sealant orifice 12 towards the blasthole walls 31. The sealant begins to rise in the blasthole and enters into the fractures 30.

Figure 4:
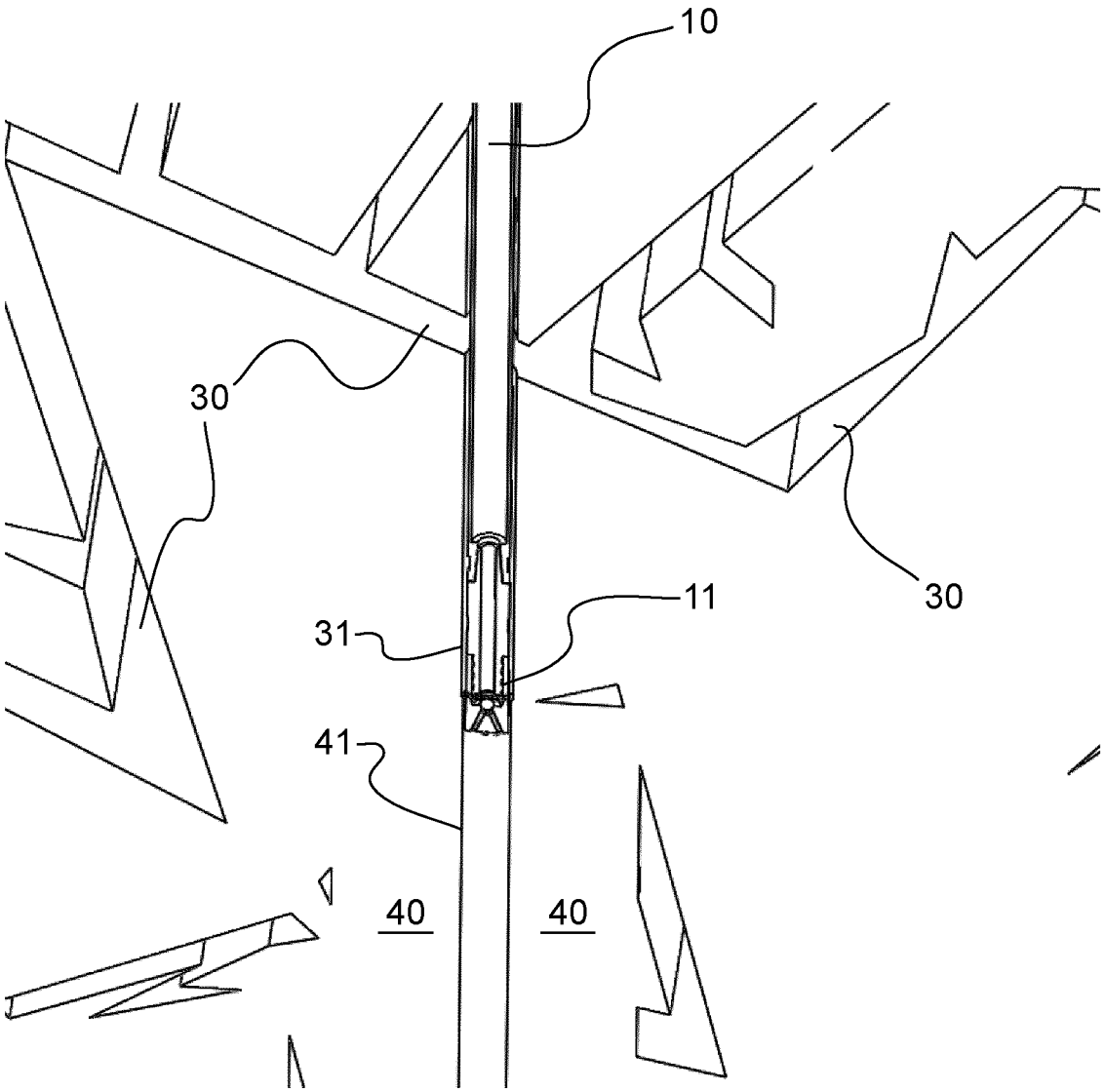
FIG. 4 illustrates a cross-sectional view of one exemplary embodiment inside a blasthole, when lifting the drill assembly.

FIG. 4 illustrates a cross-sectional view of one exemplary embodiment inside a blasthole, when lifting the drill assembly 10, 11. While lifting the drill bit 11, the sealant is pumped through the sealant orifice 12 and the drill assembly comprising the drill rod 10 and the drill bit 11 is rotated. The sealant orifice 12 releases the sealant and the centrifugal force caused by rotating the drill bit pushes the sealant towards the blasthole wall 31. The sealant enters deeper the fractures 30 due to the pressure provided by the pump configured to pump the sealant and the centrifugal force. Blocked fractures 40 do not cause problems during the later stage when pumping the explosives into the blasthole.

The drill bit 11 diameter is wider below the level of the sealant orifice 12 than at the level of the sealant orifice 12. In one embodiment the drill bit 11 diameter is at its widest below the level of the sealant orifice 12. When the drill bit 11 is lifted and rotated along the blasthole wall 31, the drill bit 11 shapes the blasthole wall 31. Any excess sealant is kept above the drill bit 11. As a result, the blasthole wall 31 turns into a sealed wall 41, coated with the sealant.

In one embodiment the object 20 to be dropped into the hollow drill rod 10 is a ball. The ball 20 is suitable shape to pass through the hollow drill rod 10 as there are no edges that could hinder the travel. In one embodiment the object 20 shape may comprise edges and/or the object 20 may comprise an elongated shape. In one embodiment the object 20 has larger relative density than the sealant. In one embodiment the ball 20 has larger relative density than the sealant. This prevents the object 20 from rising from the seat 18 as the sealant is pumped to the drill bit 11. In one embodiment the ball 20 is made of metal. The material of the object may be durable to withstand the chemical stress caused by the flushing fluid and/or the sealant; and the mechanical stress caused by the drilling environment. In one embodiment the ball 20 has a distinctive colour to assist visually locating the ball 20 at a dirty environment.

Figure 5:
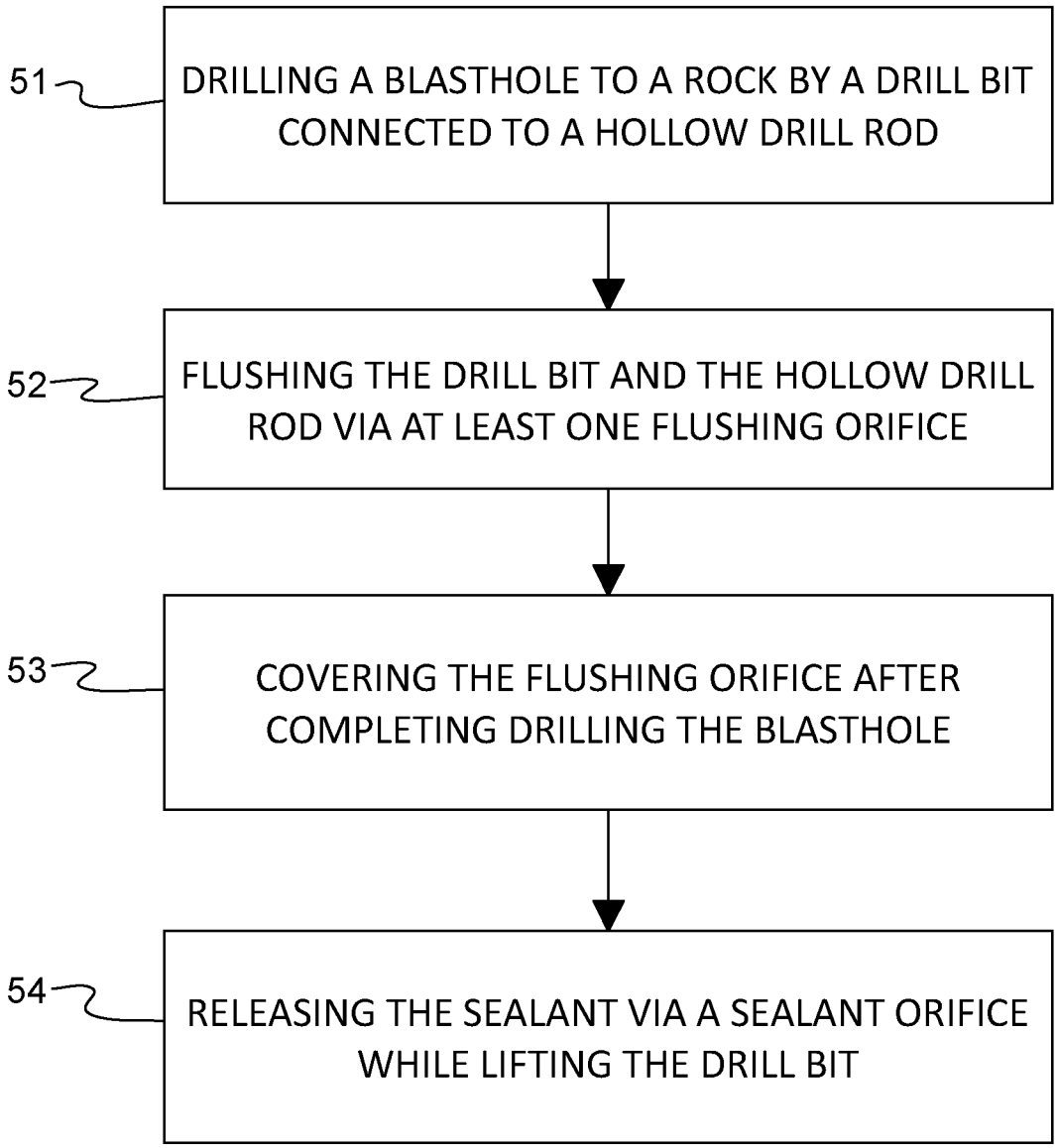
FIG. 5 illustrates schematically steps of the method for drilling the blasthole.

FIG. 5 illustrates schematically steps of the method for drilling the blasthole. In the first step 51 the method comprises drilling a blasthole to the rock by a drill bit 11 connected to the hollow drill rod 10. Step 52 comprises flushing the drill bit 11 and the hollow drill rod via at least one flushing orifice 19. Step 53 comprises covering the flushing orifice 19 after completing drilling the blasthole. Step 54 comprises releasing the sealant via the sealant orifice while lifting the drill bit 11.

A method for sealing a blasthole wall is disclosed. The method comprises the steps of drilling a blasthole to a rock by a drill bit connected to a hollow drill rod; flushing the drill bit and the hollow drill rod via at least one flushing orifice; providing a sealant to the hollow drill rod; and releasing the sealant to the blasthole wall while lifting the drill bit. The drill bit comprises a flushing orifice and a sealant orifice, wherein the flushing orifice is below the sealant orifice; and the method comprises covering the flushing orifice after completing drilling the blasthole; providing the sealant to the drill bit; and releasing the sealant via the sealant orifice while lifting the drill bit. In one embodiment, the method comprises rotating the drill bit while releasing the sealant via the sealant orifice, wherein the centrifugal force is pushing the sealant towards the blasthole wall. In one embodiment, the drill bit diameter below the level of the sealant orifice is wider than at the level of the sealant orifice, wherein lifting the drill bit causes shaping the sealant along the blasthole wall. In one embodiment, the method comprises covering the lower flushing orifice by dropping a ball into the hollow drill rod, wherein the ball has larger relative density than the sealant. In one embodiment, the ball is made of metal. In one embodiment, the drill bit comprises a seat for the ball. In one embodiment, the drill bit comprises an female thread for connecting the drill bit to the drill rod and a chamber below the female thread, wherein the sealant orifice leads to said chamber.

Alternatively, or in addition, a drill bit for sealing a blasthole wall is disclosed. The drill bit comprises connecting means for connecting to a hollow drill rod; and a flushing orifice, a sealant orifice positioned higher than the flushing orifice; and a seat configured to receive a blocking object from the drill rod for covering the flushing orifice; and wherein the drill bit is configured to receive a sealant from the drill rod and let the sealant out via the sealant orifice. In one embodiment, the drill bit diameter below the level of the sealant orifice is wider than at the level of the sealant orifice. In one embodiment, the blocking object is a ball having larger relative density than the sealant. In one embodiment, the ball is made of metal. In one embodiment, the seat is a seat for the ball. In one embodiment, the connecting means comprise an female thread for connecting to the drill rod and a chamber below the female thread, wherein the sealant orifice leads to said chamber.

Any range or device value given herein may be extended or altered without losing the effect sought.

Although at least a portion of the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A method for sealing a blasthole wall, comprising the steps of:

drilling a blasthole to a rock by a drill bit connected to a hollow drill rod;

flushing the drill bit and the hollow drill rod via at least one flushing orifice;

providing a sealant to the hollow drill rod; and releasing the sealant to the blasthole wall while lifting the drill bit, wherein:

the drill bit comprises a flushing orifice and a sealant orifice, wherein the flushing orifice is below the sealant orifice; and the method comprises:

covering the flushing orifice after completing drilling the blasthole;

providing the sealant to the drill bit;

releasing the sealant via the sealant orifice while lifting the drill bit; and rotating the drill bit while releasing the sealant, creating a centrifugal force that aids in distributing the sealant evenly along the blasthole wall; wherein the sealant orifice allows the sealant to penetrate into fractures within the blasthole wall, ensuring sealing.

2. A method according to claim 1, wherein the drill bit is rotated while releasing the sealant via the sealant orifice such that centrifugal force pushes the sealant towards the blasthole wall.

3. A method according to claim 1, wherein the drill bit diameter below a level of the sealant orifice is wider than at the level of the sealant orifice, wherein lifting the drill bit causes shaping the sealant along the blasthole wall.

4. A method according to claim 1, further comprising covering the flushing orifice by dropping a ball into the hollow drill rod, wherein the ball has larger relative density than the sealant.

5. A method according to claim 4, wherein the ball is made of metal.

6. A method according to claim 4, wherein the drill bit further comprises a seat for the ball.

7. A method according to claim 1, wherein the drill bit comprises a female thread for connecting the drill bit to the drill rod and a chamber below the female thread, wherein the sealant orifice leads to said chamber.

8. A drill bit for sealing a blasthole wall, comprising:

connecting means for connecting to a hollow drill rod;

a flushing orifice;

a sealant orifice positioned higher than the flushing orifice; and a seat configured to receive a blocking object from the drill rod for covering the flushing orifice;

wherein the drill bit is configured to receive a sealant from the drill rod and let the sealant out via the sealant orifice;

wherein the drill bit is configured to be rotated while releasing the sealant, creating a centrifugal force that aids in distributing the sealant evenly along the blasthole wall; and wherein the sealant orifice allows the sealant to penetrate into fractures within the blasthole wall, ensuring sealing.

9. A drill bit according to claim 8, wherein the drill bit diameter below a level of the sealant orifice is wider than at the level of the sealant orifice.

10. A drill bit according to claim 8, wherein the blocking object is a ball having larger relative density than the sealant.

11. A drill bit according to claim 10, wherein the ball is made of metal.

12. A drill bit according to claim 10, wherein the seat is a seat for the ball.

13. A drill bit according to claim 8, wherein the connecting means comprise a female thread for connecting to the drill rod and a chamber below the female thread, wherein the sealant orifice leads to said chamber.

* * * * *